US008387980B2

(12) United States Patent
Kang et al.

(10) Patent No.: US 8,387,980 B2
(45) Date of Patent: Mar. 5, 2013

(54) IMAGE FORMING APPARATUS

(75) Inventors: Hoon Kang, Hwaseong-si (KR); Chun-seung Yang, Suwon-si (KR); Myung-song Jung, Gunpo-si (KR); Jun-young Lee, Yongin-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 471 days.

(21) Appl. No.: 12/274,584

(22) Filed: Nov. 20, 2008

(65) Prior Publication Data

US 2009/0185198 A1 Jul. 23, 2009

(30) Foreign Application Priority Data

Jan. 18, 2008 (KR) ..... 10-2008-0005868

(51) Int. Cl.
*B65H 39/10* (2006.01)
*B65H 5/00* (2006.01)

(52) U.S. Cl. ..... 271/303; 271/225

(58) Field of Classification Search ..... 271/184, 271/303, 305, 225
See application file for complete search history.

(56) References Cited

U.S. PATENT DOCUMENTS

| | | | | |
|---|---|---|---|---|
| 4,151,038 | A * | 4/1979 | Bottasso et al. | 156/507 |
| 5,263,706 | A * | 11/1993 | Okada | 271/287 |
| 5,472,185 | A * | 12/1995 | Kollann et al. | 271/303 |
| 5,718,426 | A * | 2/1998 | Youn | 271/225 |
| 6,244,594 | B1 * | 6/2001 | Araseki et al. | 271/293 |
| 6,776,408 | B2 | 8/2004 | Suzuki et al. | |
| 7,708,276 | B2 * | 5/2010 | Okamoto et al. | 271/303 |
| 7,845,639 | B2 * | 12/2010 | Lyga et al. | 271/303 |
| 7,887,053 | B2 * | 2/2011 | Smith et al. | 271/303 |
| 2008/0185770 | A1 * | 8/2008 | Smith et al. | 271/3.16 |
| 2010/0044957 | A1 * | 2/2010 | Yang | 271/225 |

FOREIGN PATENT DOCUMENTS

| | | |
|---|---|---|
| JP | 2000-302311 | 10/2000 |
| JP | 2001-261225 | 9/2001 |
| JP | 2002-348027 | 12/2002 |

OTHER PUBLICATIONS

Korean Office Action dated Apr. 25, 2012, from Korean Patent Application 10-2008-0005868.
Korean Office Action dated Apr. 25, 2012, from Korean Patent Application 10-2008-0005868 (previously submitted in the Information Disclosure Statement filed on Jul. 20, 2012).
Korean Notice of Allowance dated Jan. 23, 2013, from Korean Patent Application 10-2008-0005868.

* cited by examiner

*Primary Examiner* — Patrick Cicchino
(74) *Attorney, Agent, or Firm* — Staas & Halsey LLP

(57) ABSTRACT

An image forming apparatus including: a plurality of medium trays to stack a print medium having an image formed thereon by an image forming unit; a driving source to momentarily apply a direction switching signal; a selector to select a carrying path of the print medium having the image formed thereon, the carrying path directing the print medium to one of the plurality of medium trays; and a switch unit connected to the driving source to set a position of the selector in order to direct the print medium along the carrying path according to the direction switching signal. Accordingly, power is only used momentarily to direct the print medium to a medium tray from among a plurality of medium trays.

18 Claims, 13 Drawing Sheets

IMAGE FORMING APPARATUS

CROSS-REFERENCE TO RELATED APPLICATION

This application claims all benefits accruing under 35 U.S.C. §119 from Korean Patent Application No. 2008-5868, filed on Jan. 18, 2008 in the Korean Intellectual Property Office, the disclosure of which is incorporated herein by reference.

BACKGROUND OF THE INVENTION

1. Field of the Invention

Aspects of the present invention relate to an image forming apparatus, and more particularly to an image forming apparatus having a direction switch to switch an ejecting path of a print medium.

2. Description of the Related Art

In general, an image forming apparatus is connected to a host system and forms an image on a print medium (such as paper, a transparency, etc.) corresponding to image data received from the host system. The image forming apparatus includes a printer to print the image data on the print medium, a facsimile to transmit the image data to another facsimile, a scanner to read an image from a document to generate the image data, a copying machine to copy the image data from one print medium to another, and a multi-function peripheral (MFP) into which the functions of the foregoing devices are integrated. In particular, the multi-function peripheral (MFP) has increased in demand as wired/wireless communication technologies are developed and various functions (such as E-mailing, web-page direct printing, etc.) are added thereto.

As the image forming apparatus has diverse functions and network capabilities, the image forming apparatus can be simultaneously used by a plurality of users. Thus, the image forming apparatus is in need of increasing a medium tray capacity to receive the printing-completed media. Furthermore, a plurality of media trays is needed to classify the print media according to sizes and contents.

To this end, a conventional image forming apparatus includes an auxiliary medium tray added to a main medium tray, where the printing-completed media are piled, through an auxiliary body. In this case, the image forming apparatus includes a direction switch to direct a printing-completed medium to either of the main medium tray provided in a main body or the auxiliary medium tray added through the auxiliary body. Moreover, the direction switch includes a selector to selectively direct the printing-completed medium to either of the main tray or the auxiliary medium tray.

Meanwhile, the conventional image forming apparatus includes a solenoid or a motor to drive the direction switch. In case of the solenoid, the selector is directly coupled with the solenoid and selects a carrying direction as the solenoid is driven. Thus, in the case that the solenoid is used, electric power is continuously applied to the solenoid so as to move the selector in a certain direction.

As shown in FIG. 8A, to move the selector for directing the printing-completed medium toward the main medium tray, a positive (+) electric power has to be applied from a switching moment (a) to another switching moment (b). On the other hand, to move the selector for directing the printing-completed medium toward the auxiliary medium tray, a negative (−) electric power has to be applied from a switching moment (b) to another switching moment (c). Thus, when the solenoid is used, the electric power is successively supplied to the solenoid regardless of which direction the selector moves in.

Accordingly, power consumption increases, and the continuously supplied power causes heat generation and thus shortens a lifespan of the solenoid.

Furthermore, in case of the motor, the electric power is also continuously supplied to the motor while the selector moves in a certain direction, thereby increasing the power consumption and generating noise due to a driving of the motor.

SUMMARY OF THE INVENTION

Several aspects and example embodiments of the present invention provide an image forming apparatus having a direction switch for switching a direction of carrying a print medium with low noise and low power consumption.

Additional aspects and/or advantages of the invention will be set forth in part in the description which follows and, in part, will be obvious from the description, or may be learned by practice of the invention.

In accordance with an example embodiment of the present invention, there is provided an image forming apparatus to form an image on a print medium, the image forming apparatus including: a plurality of medium trays to selectively stack the print medium having the image formed thereon by an image forming unit; a driving source to momentarily apply a direction switching signal; a selector to select a carrying path of the print medium according to the direction switching signal, and to direct the print medium having the image formed thereon along the carrying path to one of the plurality of medium trays; and a switch unit connected to the driving source to set a position of the selector in order to direct the print medium along the carrying path according to the direction switching signal of the driving source.

According to an aspect of the present invention, the driving source may include a solenoid that moves based on an electromagnetic force.

According to an aspect of the present invention, the switch unit may rotate the selector while interlocking with a lateral movement of the solenoid.

According to an aspect of the present invention, the switch unit may include: a push switch to move, while interlocking with the solenoid, in a first direction or a second direction opposite the first direction according to a movement of the solenoid; an elastic member to elastically bias the selector to in a predetermined rotational direction; and a lever pressing member connected to the push switch and to press the selector according to a movement of the push switch.

According to an aspect of the present invention, the image forming apparatus may further include a switch arm provided between the solenoid and the push switch to cause a movement of the push switch in the first direction or the second direction according to the movement of the solenoid.

According to an aspect of the present invention, the image forming apparatus may further include a main body including the image forming unit, and an auxiliary body connected to the main body, wherein the plurality of medium trays include a main medium tray provided in the main body, and an auxiliary medium tray provided in the auxiliary body.

According to an aspect of the present invention, the selector may rotate between a first position to direct the print medium to the main medium tray and a second position to direct the print medium to the auxiliary medium tray.

In accordance with another example embodiment of the present invention, there is provided an image forming apparatus to form an image on a print medium and to selectively output the print medium having the image formed thereon to one of a plurality of medium trays, the image forming apparatus including: a driving source to momentarily apply a direction switching signal; and a selector to select a carrying path of the print medium according to the direction switching signal, and to direct the print medium having the image formed thereon along the carrying path to the one of the plurality of medium trays.

In accordance with yet another example embodiment of the present invention, there is provided an image forming apparatus to form an image on a print medium and to selectively output the print medium having the image formed thereon to one of a plurality of medium trays, the image forming apparatus including: a selector to direct the print medium having the image formed thereon along a first carrying path to a first medium tray of the plurality of medium trays when in a first position, and to direct the print medium having the image formed thereon along a second carrying path to a second medium tray of the plurality of medium trays when in a second position, wherein a momentary electrical force is applied to set the selector in the first position or the second position.

In accordance with still another example embodiment of the present invention, there is provided a method of controlling an image forming apparatus to output a print medium onto one of a plurality of medium trays, the method including: setting a selector to a first position to direct the print medium to a first medium tray of the plurality of medium trays when a first momentary electrical power is applied; and setting a selector to a second position to direct the print medium to a second medium tray of the plurality of medium trays when a second momentary electrical power is applied.

In accordance with another example embodiment of the present invention, there is provided a method of controlling an image forming apparatus to direct a print medium, the method including: setting a selector to a first position to direct the print medium along a first carrying path when a first momentary electrical power is applied; and setting a selector to a second position to direct the print medium along a second carrying path when a second momentary electrical power is applied.

In addition to the example embodiments and aspects as described above, further aspects and embodiments will be apparent by reference to the drawings and by study of the following descriptions.

BRIEF DESCRIPTION OF THE DRAWINGS

A better understanding of the present invention will become apparent from the following detailed description of example embodiments and the claims when read in connection with the accompanying drawings, all forming a part of the disclosure of this invention. While the following written and illustrated disclosure focuses on disclosing example embodiments of the invention, it should be clearly understood that the same is by way of illustration and example only and that the invention is not limited thereto. The spirit and scope of the present invention are limited only by the terms of the appended claims. The following represents brief descriptions of the drawings, wherein:

DETAILED DESCRIPTION OF THE EMBODIMENTS

Figure 1:
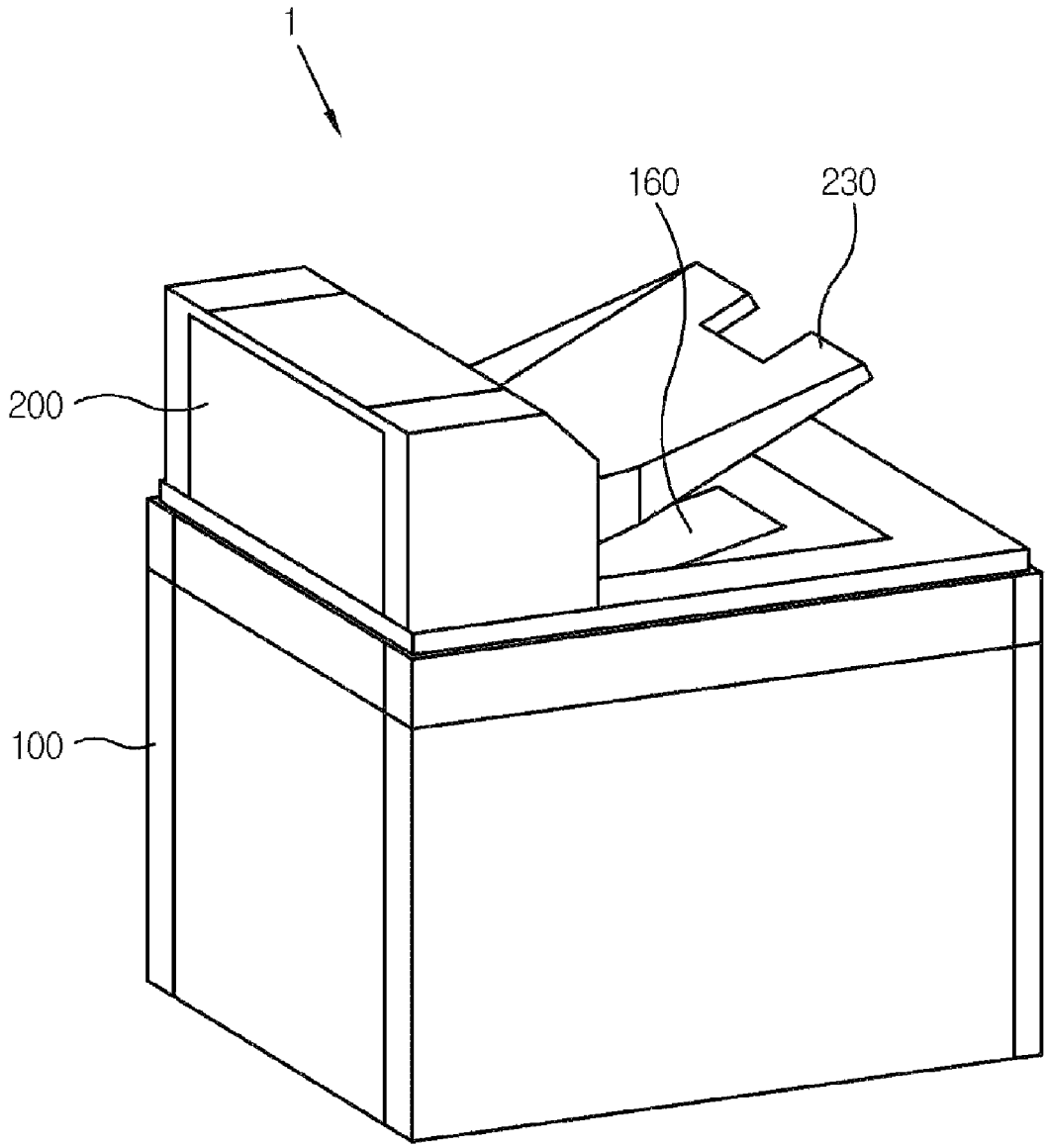
FIG. 1 is a schematic perspective view of an image forming apparatus according to an example embodiment of the present invention.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

Figure 2:
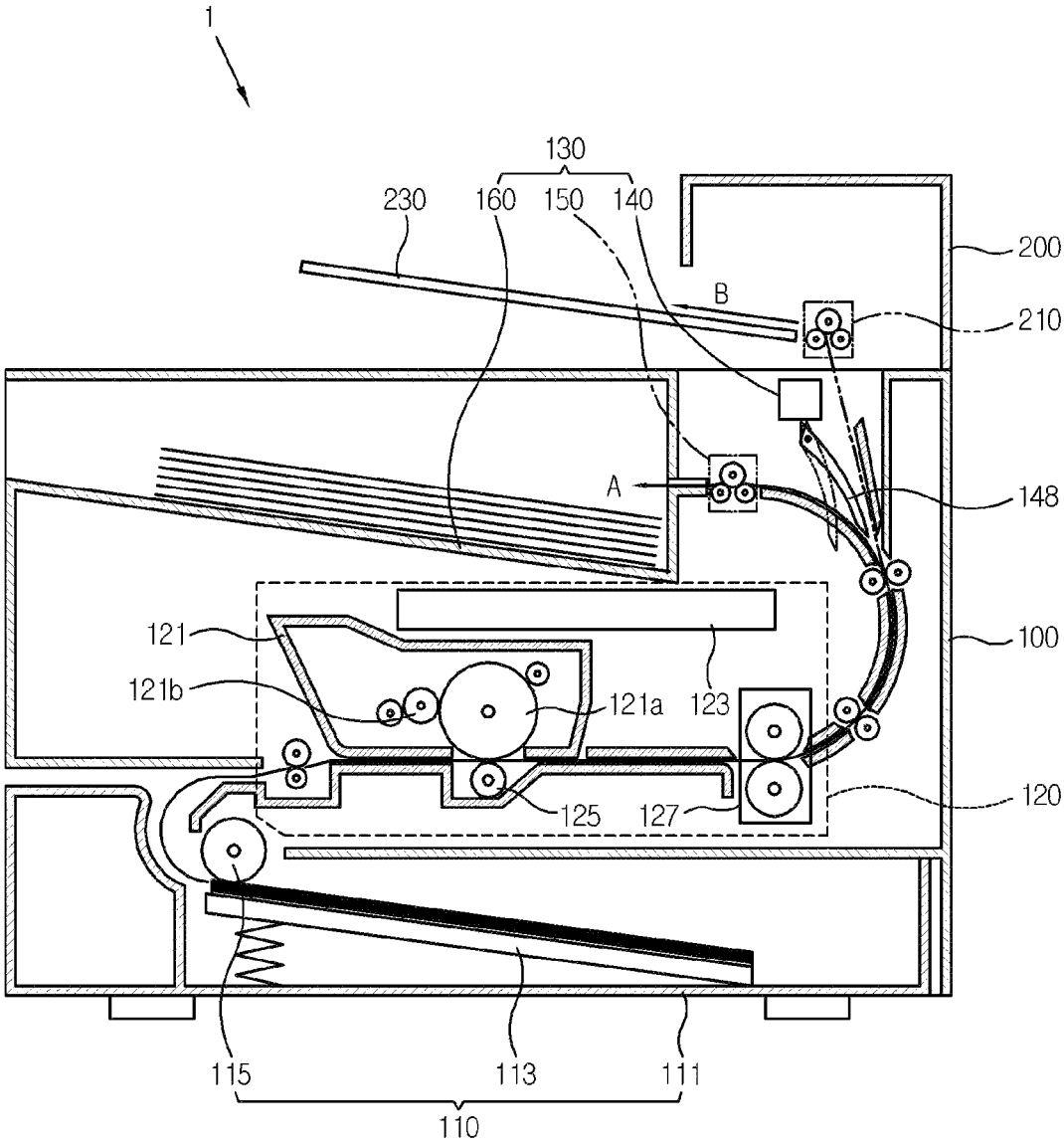
FIG. 2 is a schematic cross-section view of an image forming apparatus according to an example embodiment of the present invention.

FIG. 1 is a schematic perspective view of an image forming apparatus 1 according to an example embodiment of the present invention, and FIG. 2 is a schematic cross-section view of an image forming apparatus 1 according to an example embodiment of the present invention. Referring to FIGS. 1 and 2, the image forming apparatus 1 includes a main body 100 including an image forming unit 120, and an auxiliary body 200 including an auxiliary medium tray 230 provided above the main body 100 to receive a printing-completed medium from the main body 100.

As shown in FIG. 2, the main body 100 includes a medium feeding unit 110 to supply a print medium (such as paper, a transparency, etc.), the image forming unit 120 to form an image by applying a developer to the print medium, and a medium ejecting unit 130 to eject the medium on which printing is completed in the image forming unit 120 to an outside.

The medium feeding unit 110 includes a feeding cassette 111, a knock-up plate 113 provided in the feeding cassette 111 to knock up the print medium, and a pick-up roller 115 to pick up the print medium from the knock-up plate 113. The medium feeding unit 110 may be detachably provided in the main body 100 of the image forming apparatus 1, and refilled with the print medium when the print medium is used up. However, it is understood that aspects of the present invention are not limited thereto. For example, a plurality of feeding units 110 may be detachably provided inside the main body 100, and/or rotatably provided outside the main body 100.

The image forming unit 120 forms an image on the print medium supplied from the feeding unit 110. The image forming unit 120 includes a developing unit 121 to apply a developer on the print medium, a light scanning unit 123 to form a latent image on a photosensitive body 121*a* of the developing unit 121, a transferring unit 125 to transfer the developer from the photosensitive body 121*a* to the print medium, and a fusing unit 127 to fuse the developer on the print medium.

The developing unit 121 is detachably provided on the main body 100 of the image forming apparatus 1 in order to apply the developer filled therein to the print medium to thereby form an image. When all of the developer is used up, the developing unit 121 may be replaced with a new one filled with the developer. The developing unit 121 includes the photosensitive body 121*a* where the developer is applied, and a developing roller 121*b* to apply the developer to the latent image on the photosensitive body 121*a*

The light scanning unit 123 emits light on a surface of the photosensitive body 121*a* and forms a latent image corresponding to image data. The transferring unit 125 applies a bias voltage, which has electric polarity opposite to that of the developer, to a rear side of the print medium, thereby transferring the developer from the surface of the photosensitive body 121*a* to the print medium. The fusing unit 127 applies heat and pressure to the print medium, thereby fixing the developer on the print medium.

The image forming unit 120 may be a mono type that forms an image with only a black color developer on the print medium or a color type that forms an image with a plurality of colors (such as yellow, magenta, cyan and black) on the print medium.

The medium ejecting unit 130 ejects the print medium of which printing is completed in the image forming unit 120 to the outside. The medium ejecting unit 130 includes a direction switch 140 to switch a direction of carrying (i.e., directing) the printing-completed medium, a main ejecting roller 150 to guide the print medium directed by the direction switch 140 toward a main medium tray 160, and the main medium tray 160 provided in the main body 100 to stack the printing-completed medium thereon.

Figure 3:
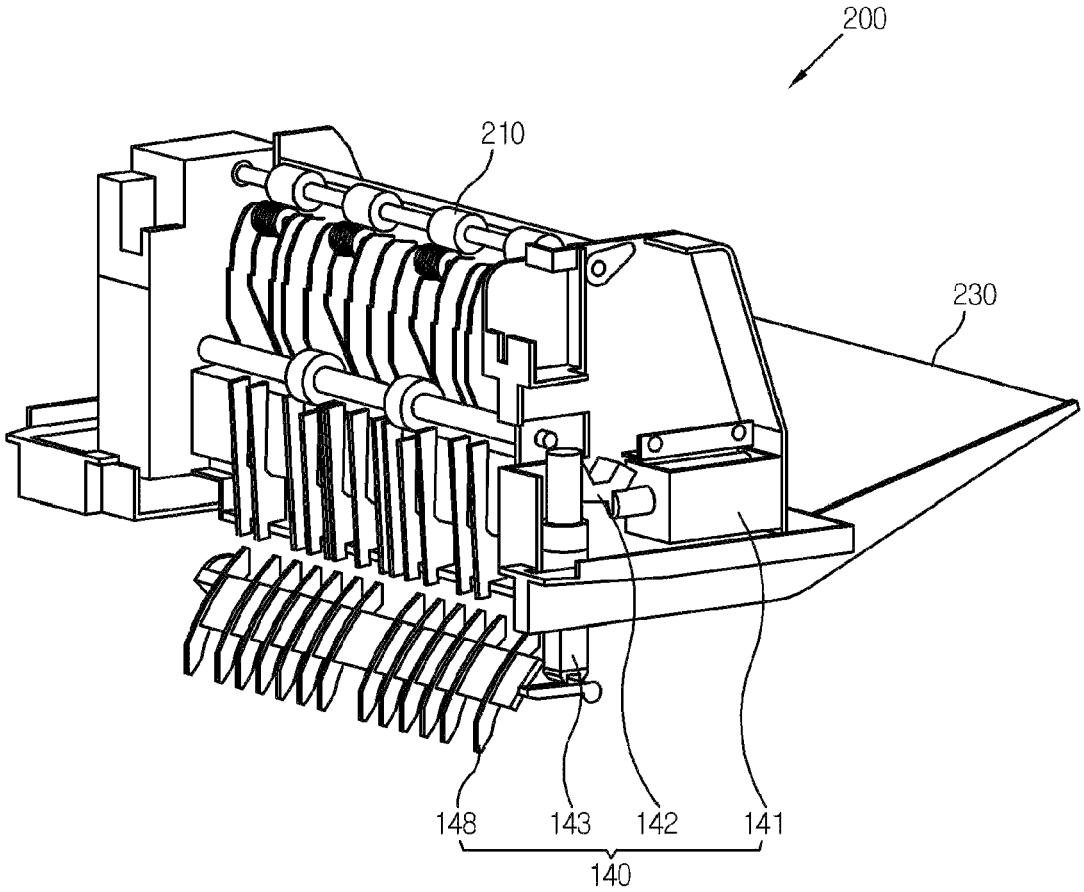
FIG. 3 is a schematic perspective view of an auxiliary body according to an example embodiment of the present invention.
Figure 4:
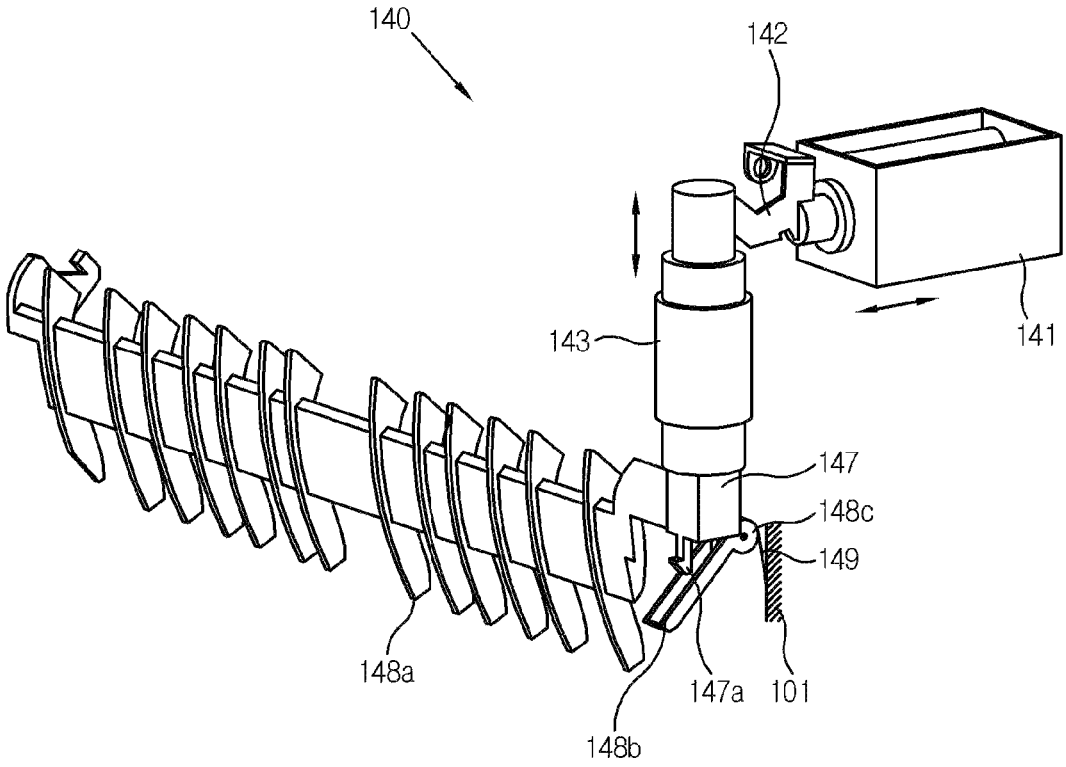
FIG. 4 is an enlarged perspective view of a direction switch of the image forming apparatus according to an example embodiment of the present invention.

FIG. 3 is a schematic perspective view of the auxiliary body 200 according to an example embodiment of the present invention, and FIG. 4 is an enlarged perspective view of the direction switch 140 of the image forming apparatus according to an example embodiment of the present invention. Referring to FIGS. 3 and 4, the direction switch 140 is provided between the image forming unit 120 and the main medium tray 160 and switches the direction of carrying the print medium to either of the main medium tray or the auxiliary medium tray 230. The direction switch 140 includes a driving source 141 to generate a direction switching signal, a selector 148 to select the carrying direction for the print medium and to guide the print medium accordingly, a switch unit 143 to set a position of the selector 148 by pressing and releasing the selector 148 according to a driving signal of the driving source 141, and an elastic member 149 to elastically return the selector 148 to an initial position when the selector 148 is released from the pressing.

Figure 8A:
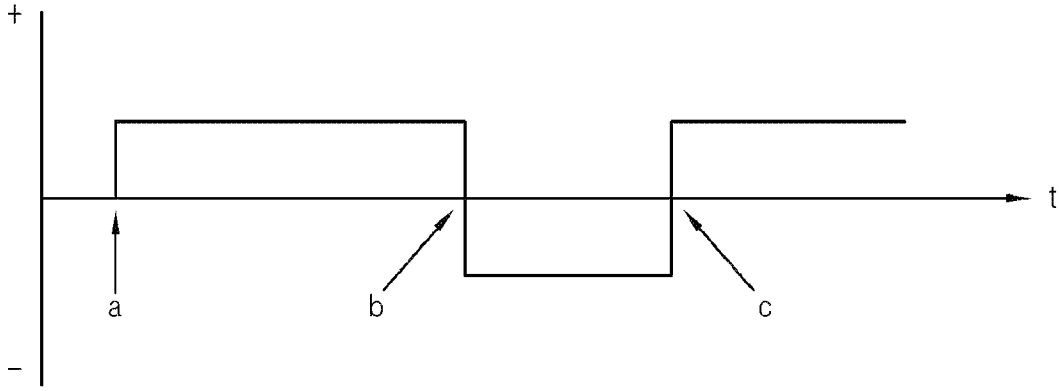
FIG. 8A is a graph illustrating a power supply time of a solenoid according to the conventional art.
Figure 8B:
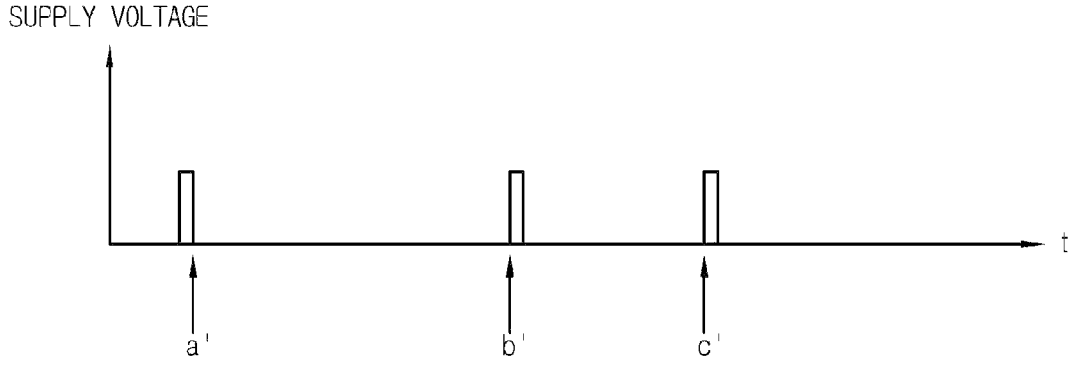
FIG. 8B is a graph illustrating power supply time of a solenoid according to an example embodiment of the present invention.

The driving source 141 drives the switch unit 143 to move up and down when receiving the direction switching signal for the print medium from a controller (not shown). For example, the driving source 141 drives the switch unit 143 to move up and down so as to press or release the selector 148, so that the selector 148 can rotate to guide the print medium. In this embodiment, the driving source 141 is implemented a solenoid. That is, the driving source 141 includes a coil 141*a* (illustrated in FIG. 6A) where electric power is applied, and a plunger 141*b* that moves along an axial direction of the coil 141*a* according to whether the electric power is applied to the coil 141*a*. In the driving source 141, the plunger 141*b* moves left and right when the electric power is applied to the coil 141*a* under a control signal of the controller (not shown). Here, the electric power is momentarily applied to the driving source 141 under the control signal of the controller. As shown in FIG. 8B, the electric power is momentarily applied at moments a, b, and c, when the selector 148 changes the direction. Thus, aspects of the present invention minimize power consumption as compared with a conventional structure where the electric power is continuously supplied to the solenoid while the selector changes the direction. It is understood that the driving source 141 may be alternatively implemented by a structure different from the solenoid that receives the electric power momentarily to drive the switch unit 143 to move up and down.

The switch unit 143 is coupled to the driving source 141 and presses the selector 148 while interlocking with the movement of the plunger 141*b*, thereby setting a position of the selector 148. As shown in FIG. 4, the switch unit 143 moves up and down according to momentary movements of the driving source 141, and presses and releases the selector 148, thereby determining the position of the selector 148. According to the example embodiment, the switch unit 143 may be implemented by a push switch that presses an object as being pushed once and releases it as being pushed once again. In particularly, the switch unit 143 may be realized by a rotary-type push switch as shown in FIG. 5.

Figure 5:
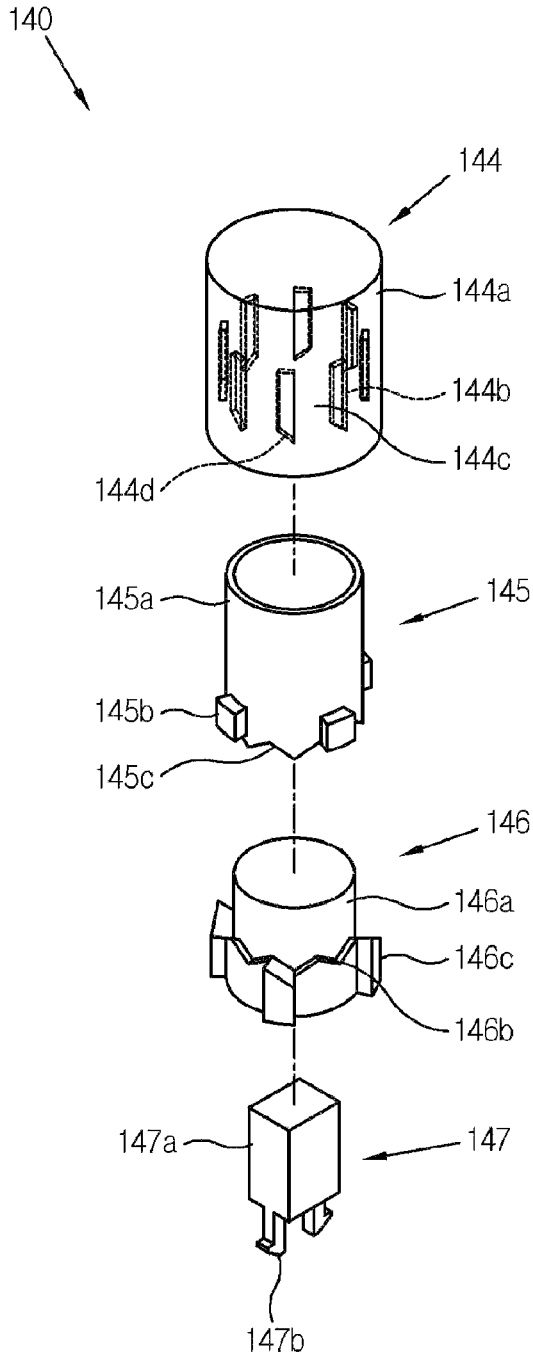
FIG. 5 is an exploded perspective view of a rotation switching unit of FIG. 4.

FIG. 5 is an exploded perspective view of the rotation switching unit 143 of FIG. 4. Referring to FIG. 5, the switch unit 143 includes a housing 144 formed with a guide groove 144*c*, a moving part 145 coupled with the plunger 141*b* of the driving source 141 and moving up and down inside the housing 144, a cam rotation part 146 moving up and down while rotating along a shape of a second cam profile 146*b* as the moving part 145 moves up and down, and a lever pressing part 147 pressing and releasing the selector 148 according to the rotation of the cam rotation part 146.

The housing 144 includes a housing body 144*a* having a cylindrical shape, and a guide projection 144*b* provided on the inside of the housing body 144*a*. The guide projection 144*b* protrudes from the inside of the housing body 144*a* by a predetermined distance and thus forms the guide groove 144*c*. Furthermore, the guide projection 144*b* has a slant bottom 144*d*, which is inclined at a predetermined angle and contacts a stopper 146*c* of the cam rotation part 146, thereby controlling the up and down movement of the cam rotation part 146.

The moving part 145 includes a moving body 145*a* accommodated inside the housing 144 and moving up and down, and a guide projection 145*b* protruding from the surface of the moving body 145*a* and inserted in the guide groove 144*b* of the housing 144. The guide projection 145*b* is inserted in the guide groove 144*b* and guides the moving part 145 so as to not rotate in the housing 144, but to move up and down according to the movement of the plunger 141*b*. Moreover, the moving body 145 is formed with a first cam profile 145*c* having a zigzag shape on the bottom thereof. The first cam profile 145*c* is engaged with a second cam profile 146*b* of the cam rotation part 146, and allows the cam rotation part 146 to rotate and couple with the cam profile 145*c* according to the up and down movement of the moving part 145. It is understood that aspects of the present invention are not limited to a zigzag shape for the first cam profile 145*c*. That is, the first cam profile 145*c* may be implemented in any shape and/or pattern corresponding to a shape and/or pattern of the second camp profile 146*b*

The cam rotation part 146 includes a rotation body 146*a* inserted in the moving body 145, the second cam profile 146*b* provided in a lower part of the rotation body 146*a* and engaged with the first cam profile 145*c* of the moving part 145, and the stopper 146*c* protruding from the surface of the second cam profile 146*b* and restricting the up and down movement of the cam rotation part 146 while contacting the bottom of the guide projection 144*b*.

The lever pressing part 147 is placed under the cam rotation part 146 and presses or releases the selector 148 while interlocking with the movement of the moving part 145 and the cam rotation part 146, thereby setting the selector 148. The lever pressing part 147 includes a pressing body 147*a* coupled to the cam rotation part 146, and a pressing leg 147*b* extended from the pressing body 147*a* and pressing a contact lever 148*b* of the selector 148.

Figure 6A:
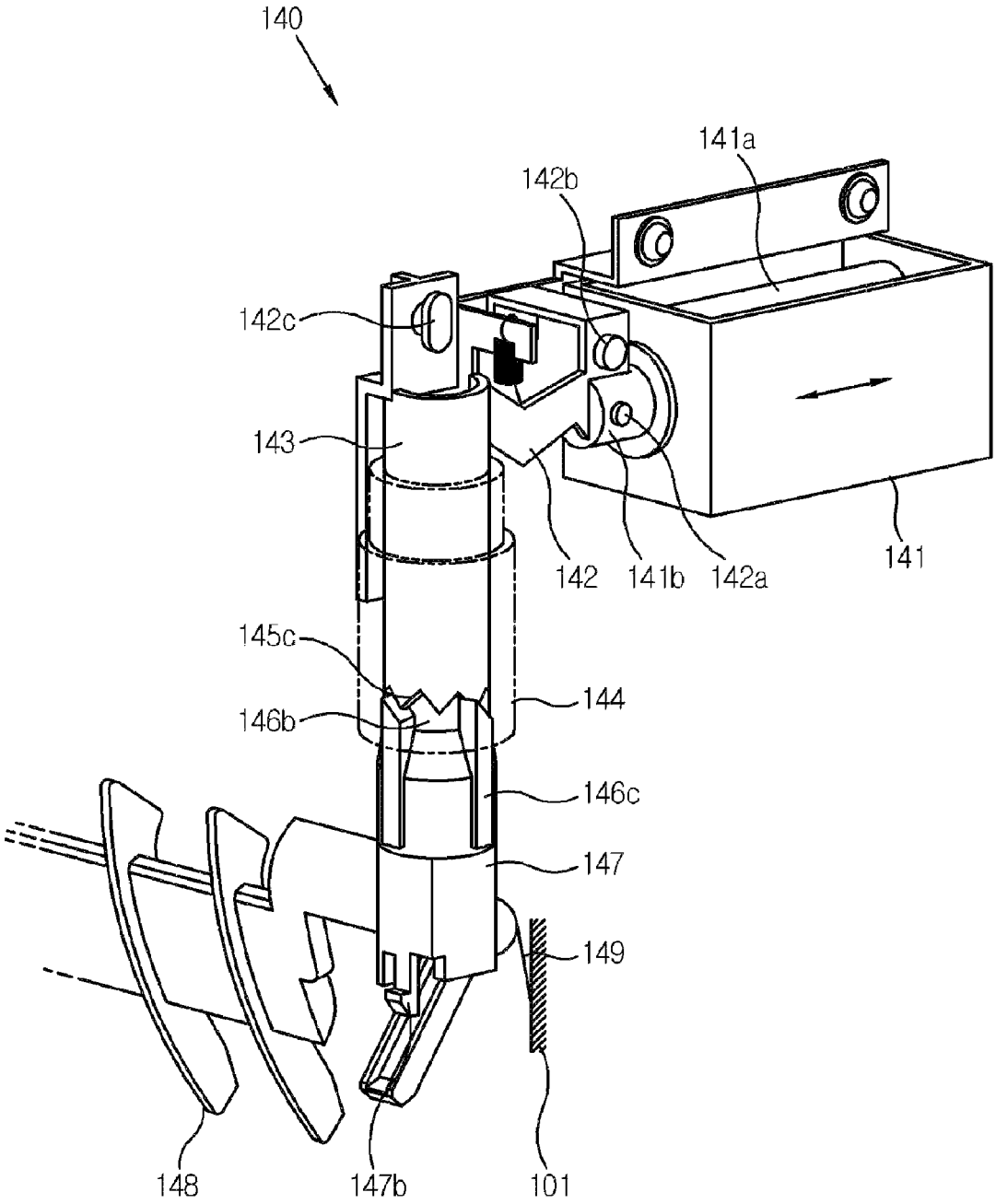
FIGS. 6A through 6C illustrate a direction switching operation of the direction switch of FIG. 4.

In addition, the direction switch 140 may further include a switch arm 142 to transmit the movement of the driving source 141 to the switch unit 143 according to a positioning relationship between the driving source 141 and the switch unit 143. For example, if the plunger 141*b* of the driving source 141 moves in the same direction as the moving part 145 of the switch unit 143, the movement of the plunger 141*b* is directly transmitted to the lever pressing part 147. On the other hand, if the plunger 141*b* moves in a perpendicular direction to the movement of the moving part 145 (as shown in FIG. 4), the switch arm 142 may be included to change the relative moving direction. That is, if the plunger 141*b* and the moving part 145 are perpendicular to each other, the switch arm 142 is provided therebetween and converts a horizontal movement of the plunger 141 into a vertical movement of the moving part 145. To this end, the switch arm 142 includes a plurality of link members 142*a*, 142*b*, and 142*c* (as shown in FIG. 6A) that can be relatively rotated with respect to rotational shafts and transmit the movement of the plunger 141*b* to the moving part 145. Here, the switch arm 142 may be provided corresponding to the positions of the moving part 145 and the driving source 141.

As shown in FIG. 2, the selector 148 is movably provided between the image forming unit 120 and the main medium tray 160 and selects the carrying path for the print medium. For example, when a user or a controller selects the main medium tray 160 as an output tray for the printing-completed medium, the selector 148 is set accordingly to prevent the print medium from being carried to the auxiliary medium tray 230, thereby guiding the print medium to be ejected to the main medium tray 160 along a path A. On the other hand, when the main medium tray 160 is full or when a user selects the printing-completed medium to be ejected to the auxiliary medium tray 230, the selector 148 is set so that the print medium is ejected to the auxiliary medium tray 230 along a path B.

As shown in FIG. 4, the selector 148 includes a selector body 148*a* rotatably provided in a main frame 101 and to guide the carrying direction of the print medium, and a contact lever 148*b* to rotate the selector body 148*a* according to the pressing of the lever pressing part 147 and to set the position of the selector body 148*a*. The selector main body 148 has a length and a width suitable to guide the printing-completed medium toward one direction but to prevent the printing-completed medium from moving toward the other direction.

The contact lever 148*b* is provided at a different inclined angle from the selector main body 148*a*, and is pressed and released by the pressing leg 147*b* of the lever pressing part 147, thereby adjusting an angle of the selector main body 148*a*. The contact lever 148*b* may, although not necessarily, be formed with a groove corresponding to the shape of the pressing leg 147*b*, so that the contact lever 148*b* can be easily pressed by the pressing leg 147*b*. Thus, when the moving part 145 moves up, the pressing leg 147*b* moves along the groove of the contact lever 148*b*, and therefore a rotation shaft 148*c* of the selector 148 is rotated to set the position of the selector body 148*a*.

The elastic member 149 is coupled to the rotation shaft 148*c* of the selector 148 and the main body frame 101 and elastically returns the contact lever 148*b* to an initial position when the selector 148 is released from the pressing of the lever pressing part 147. Furthermore, when the contact lever 148*b* returns to the initial position by the elasticity of the elastic member 149, the pressing leg 147*b* also returns to an initial position so that the cam rotation part 146 coupled with the lever pressing part 147 moves up to the initial position. The elastic member 149 may include a torsion spring, though aspects of the present invention are not limited thereto. For example, alternatively, the elastic member 149 may include a coil spring.

Furthermore, though a rotary-type push switch is used as the switch unit 143 in the current example embodiment, it is understood that aspects of the present invention are not limited thereto. Alternatively, various push switches may be used for the switch unit 143.

Meanwhile, the medium ejecting unit 130 includes the main ejecting roller 150 to carry the printing-completed medium guided by the direction switch 140 toward the main medium tray 160, and the main medium tray 160 to stack the printing-completed medium ejected by the main ejecting roller 150. The main medium tray 160 may be provided on the top of the main body 100 and piles the printing-completed medium thereon. The main medium tray 160 may also be inclined at a predetermined angle from the main ejecting roller 150 so that the printing-completed medium can be effectively piled and prevented from moving out.

The auxiliary body 200 is coupled to the top of the main body 100 and piles the printing-completed medium thereon. The auxiliary body 200 includes an auxiliary ejecting roller 210 to carry the print medium guided by the direction switch 140, and the auxiliary medium tray 230 to stack the printing-completed medium ejected by the auxiliary ejecting roller 210. With this configuration, an image forming operation of the image forming apparatus 1 and an operation of the direction switch 140 will be described below with reference to FIGS. 2 through 6C. For convenience of description, suppose that the initial position of the direction switch 140 shown in FIG. 6A is set to the direction (path A) of ejecting the print medium toward the main medium tray 160.

In the case that a user inputs a printing signal and sets the printing-completed medium to be piled on the auxiliary medium tray 230, the pick-up roller 115 of the medium feeding unit 110 picks up the print medium from the knock-up plate 113 and supplies the print medium to the image forming unit 120. The developing unit 121 applies the developer to the printing medium so as to form an image, and the fusing unit 127 applies heat and pressure to the print medium, thereby fusing the developer on the print medium.

Figure 7A:
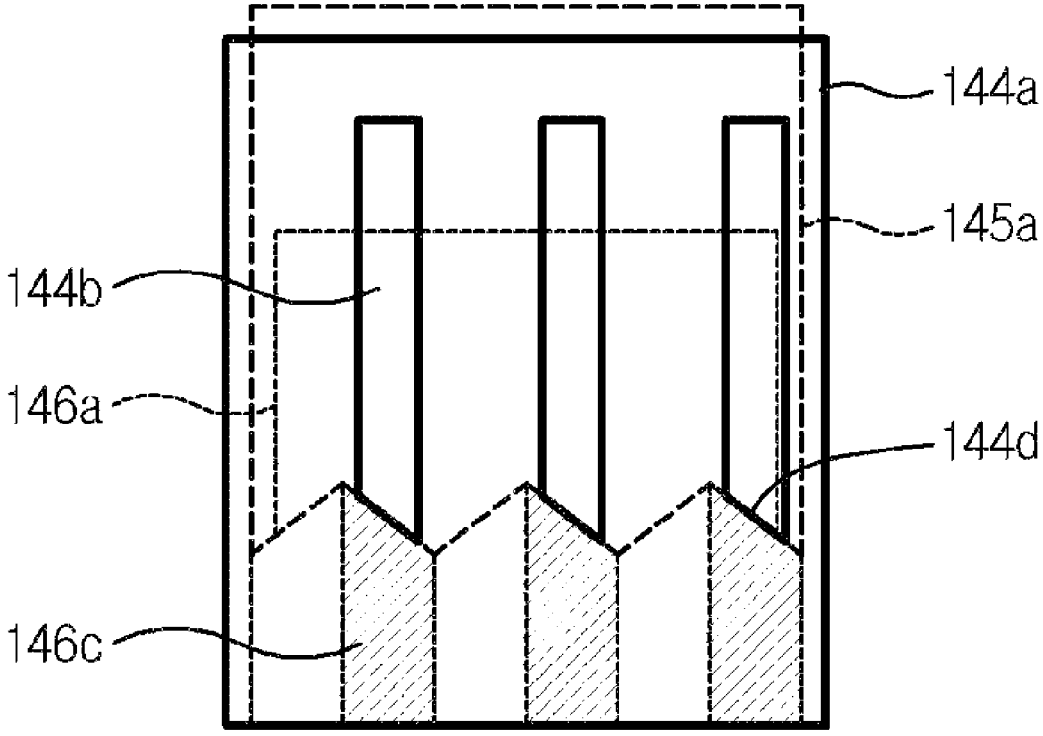
FIGS. 7A through 7C are schematic views of illustrating operations of the switching unit.
Figure 7B:
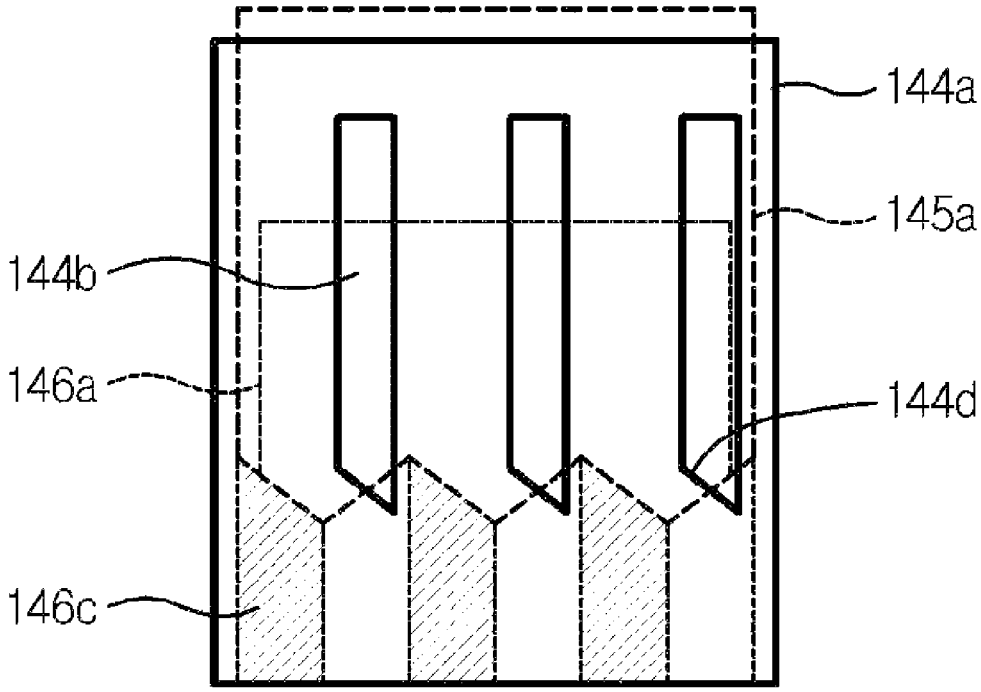
Figure 7C:
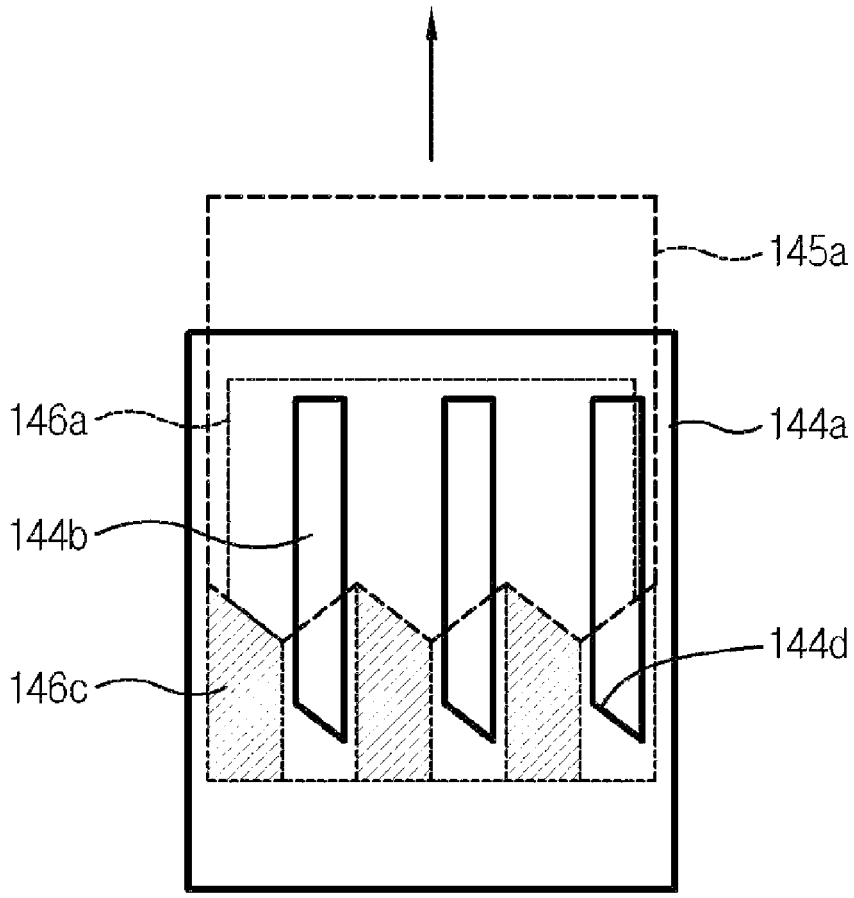

When the print medium passes by the fusing unit 127, the controller (not shown) supplies electric power to the direction switch 140 so that the selector 148 that is set in the position for directing the print medium to the main medium tray 160 can be changed to the position for directing the print medium to the auxiliary medium tray 230. Then, as shown in FIG. 8B, the driving source 141 is turned on and thus an electric current momentarily flows through the coil 141*a*. Accordingly, the plunger 141*b* moves in an arrow direction shown in FIG. 6A. At this time, as shown in FIG. 7A, the stopper 146*c* of the cam rotation part 146 contacts the slant bottom 144*d* of the guide projection 144*b* of the housing 144, thereby restricting the movement of the rotation body 146*a*. As the plunger 141*b* moves due to the momentary flow of the electric current (as shown in FIG. 7B) the cam rotation part 146 rotates and the stopper 146*c* is released from contact with the slant bottom 144*d*. Therefore, the rotation body 146*a* moves up by the elasticity of the elastic member 149, as shown in FIG. 7C.

Figure 6B:
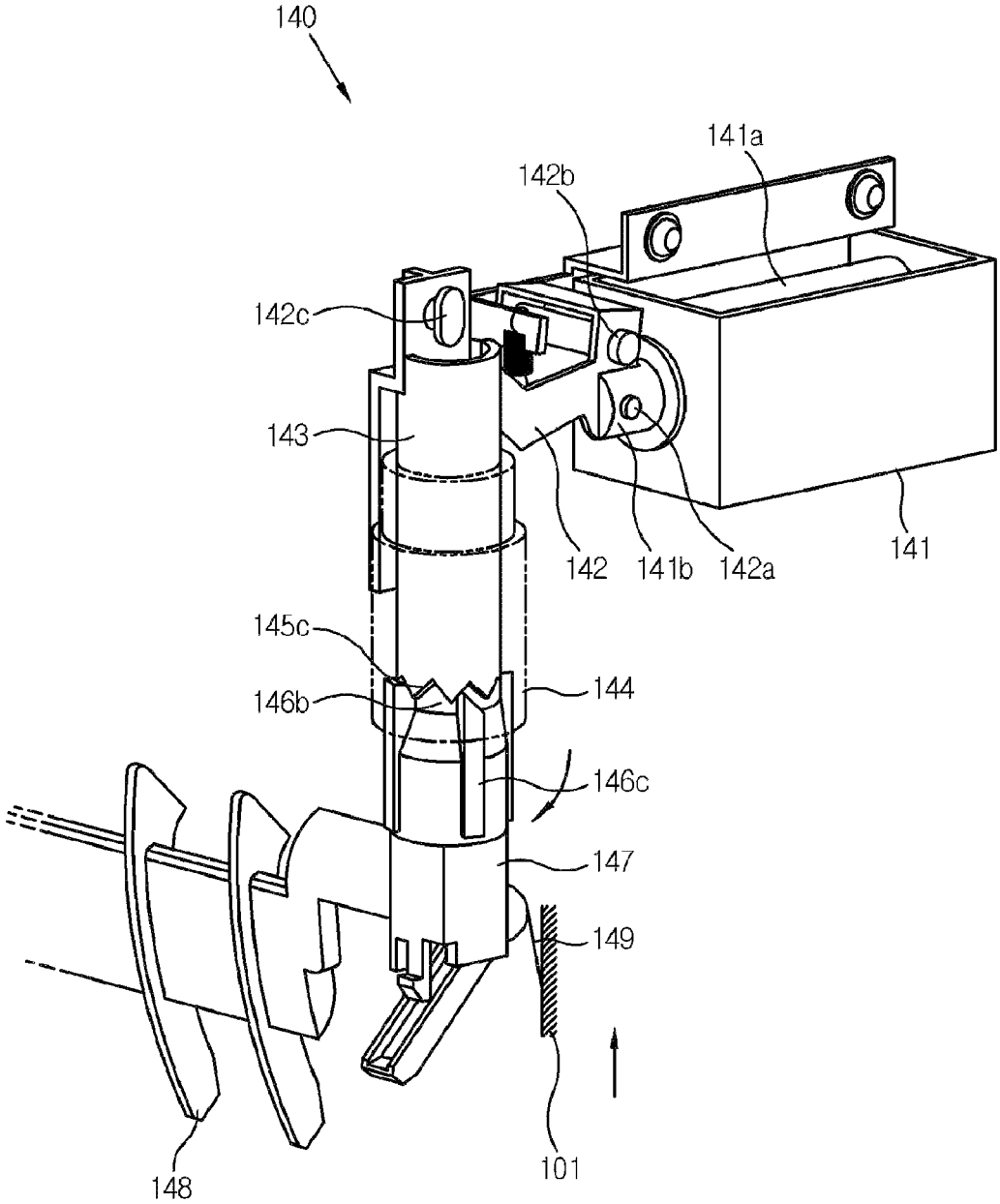
Figure 6C:
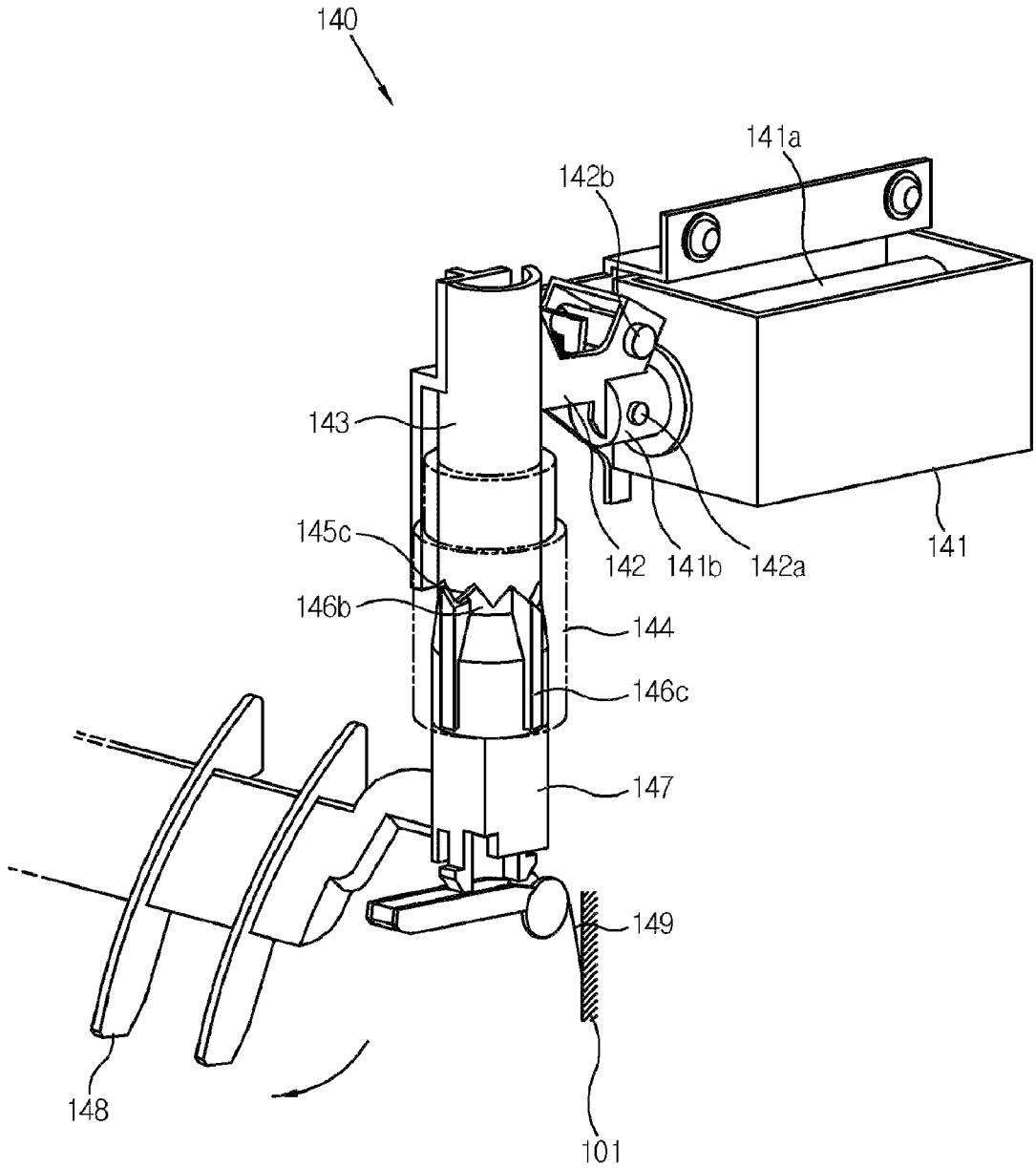

Then, the moving part 145 accommodated in the housing 144 (as shown in FIG. 6A) moves up gradually as shown in FIGS. 6B and 6C. As the moving part 145 moves up, the second cam profile 146*b* connected to the first cam profile

145*c* is rotated corresponding to the profile shape, and the cam rotation part 146 also moves up. At the same time, the pressing leg 147*b* coupled to the cam rotation part 146 moves up along the groove of the contact lever 148*b*. When the contact lever 148*b* is released from the pressing of the pressing leg 147, the elastic member 149 elastically returns so that the selector main body 148*a* can rotate in a clockwise direction.

As the contact lever 148*b* rotates, the selector 148 rotates (as shown in FIG. 6C) and switches the path to carry the print medium to the auxiliary medium tray 230 as shown in the dotted line of FIG. 2. The print medium passed through the fusing unit 127 is piled on the auxiliary medium tray 230 along the path B as guided by the direction switch 140.

Meanwhile, the direction switch 140 that is now in the position to direct the print medium along the path B moves the moving part 145 down when the electric power is again supplied to the driving source 141 according to the control signal of the controller (not shown). In this case, the pressing leg 147 presses the contact lever 148*b* so that the selector 148 can change the carrying direction as shown in FIG. 6A.

As described above, the image forming apparatus according to an example embodiment of the present invention supplies electric power to a solenoid used as a driving source at only a moment when the selector changes a guiding direction, thereby minimizing a power consumption. Furthermore, a motor is not separately used, and thus there is no noise due to a driving of the motor.

While there have been illustrated and described what are considered to be example embodiments of the present invention, it will be understood by those skilled in the art and as technology develops that various changes and modifications, may be made, and equivalents may be substituted for elements thereof without departing from the true scope of the present invention. Many modifications, permutations, additions and sub-combinations may be made to adapt the teachings of the present invention to a particular situation without departing from the scope thereof. For example, the elastic member 149 may be provided to backwardly bias the selector as necessary, as opposed biasing the selector 148 toward the direction of guiding the printing-completed medium to the auxiliary medium tray. Furthermore, a plurality of auxiliary bodies may be used, as opposed to just one auxiliary body. In this case, the plurality of auxiliary bodies may have the selectors to switch the carrying direction, respectively. Moreover, a degree of pressing one selector provided in the main body may be adjusted in order to control the rotated angle of the selector, so that the printing-completed medium can be carried to the plurality of medium trays. To this end, the intensity of electric current flowing in the solenoid may be adjusted or the moving degree of the switch unit may be adjusted. Accordingly, it is intended, therefore, that the present invention not be limited to the various example embodiments disclosed, but that the present invention includes all embodiments falling within the scope of the appended claims As described above, several aspects and example embodiments of the present invention provide an image forming apparatus in which driving power is momentarily supplied from a driving source at only a moment when a direction is changed, even though a selector is maintained in a direction switched state, so that power consumption can be reduced. Furthermore, several aspects and example embodiments of the present invention provide an image forming apparatus in which a solenoid is used as a driving source, so that there is no noise due to a conventional motor.

What is claimed is:

1. An image forming apparatus to form an image on a print medium, the image forming apparatus comprising:

a plurality of medium trays to selectively stack the print medium having the image formed thereon by an image forming unit;

a driving source to apply a direction switching force when momentary electric power is applied to the driving source;

a selector to select a carrying path of the print medium according to the direction switching force, and to direct the print medium having the image formed thereon along the selected carrying path to one of the plurality of medium trays; and a switch unit to set a position of the selector to direct the print medium along the selected carrying path according to the direction switching force, wherein the driving source comprises a solenoid and selectively drives the switch unit to move in a first direction to press the selector when momentary electric power is applied, or to move in a second direction to release the selector when momentary electric power is applied, and the momentary electric power is supplied by a controller at a moment when the switch unit sets the position of the selector, for a time less than a duration the selector is maintained in a direction switched state.

2. The image forming apparatus as claimed in claim 1, wherein the solenoid comprises:

a coil to receive the momentary electric power; and a plunger to move along an axial direction of the coil based on a momentary electromagnetic force and to apply the direction switching force to the switch unit.

3. The image forming apparatus as claimed in claim 2, wherein the switch unit pivots the selector to the position while interlocking with a movement of the plunger.

4. The image forming apparatus as claimed in claim 2, wherein the switch unit comprises:

a push switch to move in the first direction according to a movement of the solenoid or the second direction, opposite the first direction, according to an elastic bias;

a lever pressing member connected to the push switch to press the selector according to a movement of the push switch; and an elastic member to elastically bias the lever pressing member in a predetermined rotational direction and to elastically bias the push switch in the second direction.

5. The image forming apparatus as claimed in claim 4, wherein the plunger moves along a third direction substantially perpendicular to the first direction and the second direction, according to the momentary electromagnetic force.

6. The image forming apparatus as claimed in claim 5, further comprising a switch arm provided between the plunger and the push switch to cause a movement of the push switch in the first direction or the second direction.

7. The image forming apparatus as claimed in claim 1, further comprising a main body including the image forming unit, and an auxiliary body coupled to the main body, wherein the plurality of medium trays comprise a main medium tray provided in the main body, and an auxiliary medium tray provided in the auxiliary body.

8. The image forming apparatus as claimed in claim 7, wherein the selector rotates between a first position to direct the print medium along a first carrying path to the main medium tray and a second position to direct the print medium along a second carrying path to the auxiliary medium tray.

9. The image forming apparatus as claimed in claim 5, wherein:

the plurality of medium trays comprises a first medium tray and a second medium tray;

the plunger of the solenoid moves to a first position to apply the direction switching force and to a second position by the elastic bias, causing the push switch to move to a first push switch position or a second push switch position, selectively;

the push switch sets the selector in a first selector position to direct the print medium along a first carrying path to the first medium tray when the push switch is moved to the first push switch position; and the push switch sets the selector in a second selector position to direct the print medium along a second carrying path to the second medium tray when the push switch is moved to the second push switch position.

10. The image forming apparatus as claimed in claim 1, wherein:

the plurality of medium trays comprises a first medium tray and a second medium tray;

the driving source moves to a first position to apply the direction switching force when the driving source drives the switch unit to move in the first direction, causing the switch unit to move to a first switch unit position; and the driving source moves to a second position to apply the direction switching force when the driving source drives the switch unit to move in the second direction, causing the switch unit to move to a second switch unit position;

the switch unit sets the selector in a first selector position to direct the print medium along a first carrying path to the first medium tray when the switch unit is moved to the first switch unit position; and the switch unit sets the selector in a second selector position to direct the print medium along a second carrying path to the second medium tray when the switch unit is moved to the second switch unit position.

11. The image forming apparatus as claimed in claim 10, the driving source stays in the first position or the second position without electrical power being applied to the driving source.

12. An image forming apparatus to form an image on a print medium and to selectively output the print medium having the image formed thereon to one of a plurality of medium trays, the image forming apparatus comprising:

a driving source to momentarily receive electrical power and to apply a direction switching force; and a selector to select a carrying path of the print medium according to the direction switching force, and to direct the print medium having the image formed thereon along the selected carrying path to the one of the plurality of medium trays, wherein the driving source comprises a solenoid and moves to a first position when the momentary electric power is received to apply the direction switching force, causing the selector to be set to a first selector position to direct the print medium along a first carrying path to a first medium tray, or a second selector position to direct the print medium along a second carrying path to a second medium tray, wherein the first momentary electric power is supplied by a controller at a moment when the selector is set to the first position, for a time less than a duration the selector is maintained in the first position, and the second momentary electric power is supplied by the controller at a moment when the selector is set to the second position, for a time less than a duration the selector is maintained in the second position.

13. An image forming apparatus to form an image on a print medium and to selectively output the print medium having the image formed thereon to one of a first medium tray and a second medium tray, the image forming apparatus comprising:

a selector to direct the print medium having the image formed thereon along a first carrying path to the first medium tray when the selector is in a first position, and to direct the print medium having the image formed thereon along a second carrying path to the second medium tray when the selector is in a second position; and a solenoid to set the selector in the first position or the second position, wherein a momentary electric power is supplied by a controller to set the selector to the first position, for a time less than a duration the selector is maintained in the first position, and the momentary electric power is supplied by the controller to set the selector to the second position, for a time less than a duration the selector is maintained in the second position.

14. A method of controlling an image forming apparatus to output a print medium onto medium trays, the method comprising:

setting a selector to a first position to direct the print medium to a first medium tray when a first momentary electrical power is applied to the selector; and setting the selector to a second position to direct the print medium to a second medium tray when a second momentary electrical power is applied to the selector, wherein the selector is set to the first position or the second position using a solenoid, wherein the first momentary electric power is supplied by a controller at a moment when the selector is set to the first position, for a time less than a duration the selector is maintained in the first position, and the second momentary electric power is supplied by the controller at a moment when the selector is set to the second position, for a time less than a duration the selector is maintained in the second position.

15. A method of controlling an image forming apparatus to direct a print medium, the method comprising:

setting a selector to a first position to direct the print medium along a first carrying path when a first momentary electrical power is applied to the selector; and setting the selector to a second position to direct the print medium along a second carrying path when a second momentary electrical power is applied to the selector, wherein the selector is set to the first position or the second position using a solenoid, wherein the first momentary electric power is supplied by a controller at a moment when the selector is set to the first position, for a time less than a duration the selector is maintained in the first position, and the second momentary electric power is supplied by the controller at a moment when the selector is set to the second position, for a time less than a duration the selector is maintained in the second position.

16. An image forming apparatus to form an image on a print medium, the image forming apparatus comprising:

a plurality of medium trays to selectively stack the print medium having the image formed thereon by an image forming unit;

a driving source to apply a direction switching force when momentary electric power is applied to the driving source;

a selector to select a carrying path of the print medium according to the direction switching force, and to direct the print medium having the image formed thereon along the selected carrying path to one of the plurality of medium trays; and a switch unit to set a position of the selector to direct the print medium along the selected carrying path according to the direction switching force, wherein the driving source selectively drives the switch unit to move in a first direction to press the selector when momentary electric power is applied, or to move in a second direction to release the selector when momentary electric power is applied, wherein the switch unit comprises:

a push switch to move in the first direction according to the driving source or to move in the second direction, opposite the first direction, according to an elastic bias;

a lever pressing member connected to the push switch to press the selector according to a movement of the push switch, and wherein the selector comprises:

a selector body rotatably provided in a main frame of the image forming apparatus; and a contact lever to rotate the selector body, wherein the contact lever is pressed and released by the lever pressing member.

17. The image forming apparatus as claimed in claim 16, wherein the lever pressing member comprises a pressing leg, wherein the contact lever is formed with a groove corresponding to a shape of a pressing leg extending from a lower portion of the lever pressing member, and the pressing leg is movable along the groove of the contact lever.

18. The image forming apparatus as claimed in claim 1, wherein the switch unit comprises a rotary-type push switch.

* * * * *